United States Patent [19]

Whipple

[11] Patent Number: 4,606,137

[45] Date of Patent: Aug. 19, 1986

[54] WEB DRYER WITH CONTROL OF AIR INFILTRATION

[75] Inventor: Rodger E. Whipple, Neenah, Wis.

[73] Assignee: Thermo Electron Web Systems, Inc., Auburn, Mass.

[21] Appl. No.: 717,082

[22] Filed: Mar. 28, 1985

[51] Int. Cl.[4] ..... F26B 13/20

[52] U.S. Cl. ..... 34/156; 34/160; 34/242

[58] Field of Search ..... 34/54, 156, 160, 242, 34/155

[56] References Cited

U.S. PATENT DOCUMENTS

| | | | |
|---|---|---|---|
| 2,141,403 | 12/1938 | Offen | 34/54 |
| 3,783,649 | 1/1974 | Yamamoto et al. | 34/242 |
| 4,074,841 | 2/1978 | Kramer et al. | 34/156 |
| 4,271,601 | 6/1981 | Koponen et al. | 34/155 |
| 4,271,602 | 6/1981 | Grolms | 34/155 |
| 4,411,075 | 10/1983 | Blaudszun | 34/242 |
| 4,472,888 | 9/1984 | Spiller | 34/156 |
| 4,501,553 | 2/1985 | Imose et al. | 34/156 |

FOREIGN PATENT DOCUMENTS

| | | | |
|---|---|---|---|
| 2078356 | 1/1982 | United Kingdom | 34/23 |

*Primary Examiner*—Albert J. Makay
*Assistant Examiner*—David W. Westphal
*Attorney, Agent, or Firm*—Andrus, Sceales, Starke & Sawall

[57] ABSTRACT

A unique nozzle assembly (11, 12) is provided for placement within the chamber (4) of a web dryer (1) and closely adjacent a housing web slot (5, 6). The nozzle assembly generally comprises a Coanda-type nozzle (27) and a supplemental nozzle (33) disposed on the assembly so that it is positioned between the Coanda nozzle and the housing wall (3). Both the Coanda and supplemental nozzles are supplied with air from a common manifold (13) connected to an external air source. An air flow control device (34, 35) is provided for the individual air flow paths in the assembly to suitably balance the velocities of the two discharging air jets. To prevent any transient air currents inside the dryer chamber from causing web or air flow instability, a seal (43) is provided between the improved nozzle and the dryer housing wall. The seal is disposed along the head end of the nozzle; that is, closely adjacent the nozzle jet discharge ports. A pair of improved nozzles are usually disposed adjacent each housing web slot, one on each side of the web. The exact relative positioning of the nozzles in a pair may be varied according to the particular conditions encountered. To overcome any problems caused by narrow webs or a slight amount of cool room air infiltrating the warmer dryer environment, a labyrinth of expansion chambers (66) may be positioned between the inner dryer wall (3) adjacent the slots and the improved nozzles (58, 65) as per FIG. 7. In the present embodiment, the labyrinth forms part of the nozzle assemblies (44) themselves.

22 Claims, 7 Drawing Figures

WEB DRYER WITH CONTROL OF AIR INFILTRATION

U.S. PRIOR ART OF INTEREST

| Inventor | U.S. Pat. No. | Issue Date |
|---|---|---|
| Frost et al | 3,549,070 | December 22, 1970 |
| Overly | 3,587,177 | June 28, 1971 |
| Whipple | 4,414,757 | November 15, 1983 |

BACKGROUND AND SUMMARY OF THE INVENTION

This invention relates to web dryers and nozzles therefor which are used in the manufacture of paper and the like.

Numerous types of web dryers have been developed over the years, with the dryers utilizing a variety of types of nozzle assemblies. Representative assemblies are disclosed in the above identified patents, many of which use the Coanda effect as described in detail in U.S. Pat. No. 3,549,070. In U.S. Pat. No. 4,414,757, a nozzle assembly is disclosed which has a flat pressure plate adapted to form a gas flow zone with a moving web. A primary nozzle of the Coanda type is disposed at the upstream end of the pressure plate and continuously directs gas downstream along the face of the plate. A single secondary nozzle of the impingment type is disposed at the downstream terminus of the pressure plate, for reasons described in that patent.

Web dryers usually comprise a closed housing forming one or more web drying chambers or zones having a plurality of spaced parallel nozzle assemblies therein. The traveling web enters the housing through a narrow entrance slot, is acted on by air ejected from the nozzle assemblies, and ultimately exits the housing through a discharge slot. The working air is usually supplied from an outside source or sources, which normally heats the air and then passes through the nozzles into the drying zone and then exits through a suitable exhaust port.

Current web dryer technology generally requires that the housing interior be kept under a slight negative pressure, although positive pressure is also utilized in some instances. Under both circumstances, outside room air may tend to undesirably infiltrate into the housing through the web entrance and discharge slots. In addition, since the amount of pressure may vary from place to place within the housing, depending upon the location of obstructions (nozzles, for example) and the exhaust port, the infiltration of room air can be greater at one web slot than the other, causing air distribution imbalances.

For both positive and negative chamber pressures, the infiltration of room air is caused in part by the induction effect of the Coanda dryer nozzles, due to the flow of air around the curvature of the nozzles adjacent the web slots which in turn sucks air through the slots. This effect can be reduced somewhat by lowering the velocity of the jet flow through the nozzles. However, there is a lower limit to such velocity reduction, beyond which transient air currents inside the dryer chamber of air currents from adjacent nozzle jets will disrupt the desired air flow pattern.

In addition, sometimes the web may be narrower than the nozzle length, which may result in differences in flow from the nozzle assemblies between where a web is present and the web is absent. Also, it has been found that when cool room air infiltrates and contacts the nozzle parts that have been warmed by the heated dryer air, undesirable condensation may occur on the nozzle parts under certain conditions of dryer operation. Furthermore, infiltrating cool air tends to reduce the drying efficiency of the entire unit.

It is an object of the present invention to solve the aforementioned problems and to substantially and effectively reduce the infiltration of air from one zone into another in an efficient manner and at reasonable cost. It is a further object to reduce the effects of any small amount of air that may possibly still penetrate from one zone through a boundary into another zone.

In accordance with the various aspects of the invention, a unique nozzle assembly is provided for placement within one of a pair of adjacent ambient air zones and closely adjacent to the boundary therebetween. The nozzle assembly generally comprises a Coanda-type nozzle and a supplemental nozzle disposed on the assembly so that it is positioned between the Coanda nozzle and the zone boundary. Both the Coanda and supplemental nozzles are supplied with air from an air source means which in this embodiment comprises a common manifold connected to an external air source. An air flow control device is provided for the individual air flow paths in the assembly to suitably balance the velocities of the two discharging air jets.

In the disclosed embodiment, to prevent any transient air currents inside the dryer chamber from causing web or air flow instability, a seal is provided between the internally mounted improved nozzle and the dryer housing boundary wall. The seal is disposed along the head end of the nozzle; that is, closely adjacent the nozzle jet discharge ports.

In the disclosed embodiment, a pair of improved nozzles are usually disposed adjacent each housing web slot, one on each side of the web. The exact relative positioning of the nozzles in a pair may be varied according to the particular conditions encountered.

To overcome any problems caused by narrow webs or a slight amount of cool room air infiltrating the warmer dryer environment, a labyrinth of expansion chambers may be positioned between the inner dryer wall adjacent the slots and the improved nozzles. In the present embodiment, the labyrinth forms part of the nozzle assemblies themselves.

BRIEF DESCRIPTION OF THE DRAWINGS

The accompanying drawings illustrate the best mode presently contemplated by the inventor for carrying out the invention. In the drawings.

DESCRIPTION OF THE PREFERRED EMBODIMENTS

Figure 1:
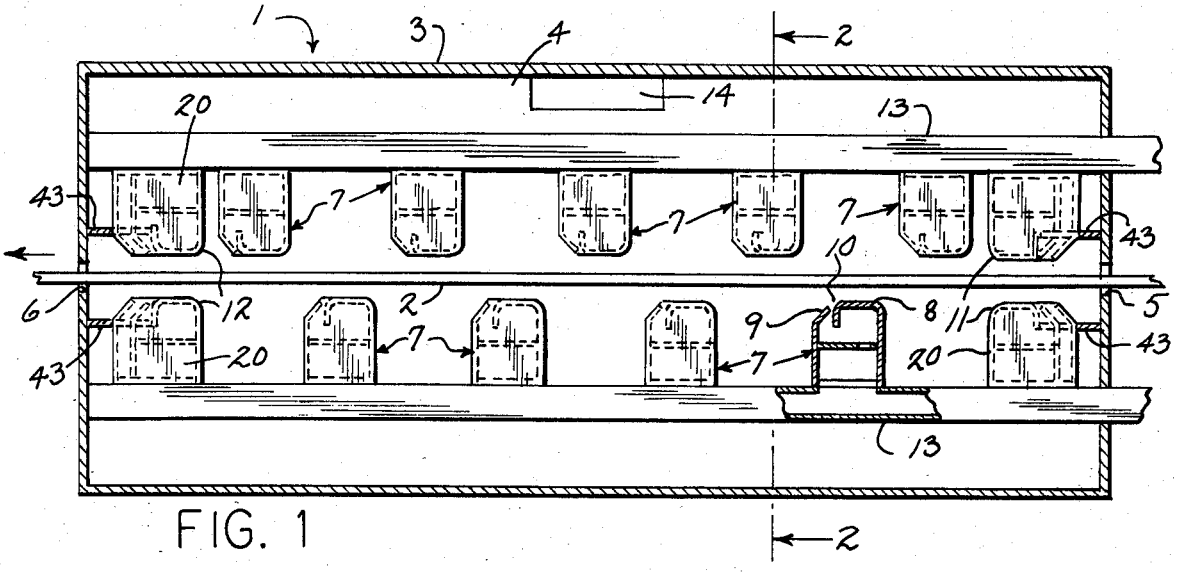
FIG. 1 is a schematic side elevation, with parts broken away and in section, showing a web dryer incorporating the various aspects of the invention.

As shown in FIG. 1, a web dryer 1 is positioned for passthrough thereof of a moving flexible continuous web 2 of paper or other sheet material. Dryer 1 comprises a closed housing 3 forming an internal web drying chamber 4 having a web-receiving entrance slot 5 at one end, and a web-receiving discharge slot 6 at the opposite end.

A plurality of intermediate upper and lower nozzle assemblies 7 are spaced a relatively substantial distance inwardly from the ends of housing 3, and may be of any suitable well-known type such as those disclosed in the aforementioned U.S. Pat. No. 3,587,177. As shown, rows of assemblies 7 are disposed on opposite sides of the traveling web 2, with each assembly facing a space between assemblies on the opposite sies. As shown on the sectional view of one of assemblies 7, these known assemblies comprise a flat pressure plate 8 which has an inwardly inclined foil plate 9 along one edge thereof, with the construction forming a slot-like nozzle 10 of the Coanda type.

A pair of upper and lower nozzle assemblies 11 are positioned upstream of the known assemblies 7, while a similar pair of upper and lower nozzle assemblies 12 are positioned downstream of assemblies 7, for purposes to be described.

Gas, which is usually heated, is continuously supplied under pressure from a suitable source, not shown, and through inlet manifold supply pipes 13 to each assembly 7, 11 and 12; is continuously discharged through the assemblies against web 2, and then passes over the web edges. The gas ultimately exits chamber 4, as through a discharge port 14. The gas flow velocity through the system would be in the usual well-known range.

As previously discussed, and at least partially due to the effect of the Coanda-type nozzles used in most state-of-the-art web dryers, infiltration of room air through web slots 5 and 6 has been found to undesirably occur, with the infiltration tending to be different in amount for each slot.

Nozzle assemblies 11 and 12 are constructed and positioned to substantially reduce and essentially eliminate the said infiltration. For this purpose, and referring to the upper and lower downstream assemblies 12 more fully illustrated in FIG. 3, each nozzle assembly 12 comprises an elongated plenum chamber 15 formed by a base plate 16 which has openings communicating with manifold pipe 13, as at 17. Assembly 12 also includes upstream and downstream vertical lateral spaced plates 18 and 19 respectively which are coextensive with base plate 16, as well as end closure plates 20. A brace 21 extends horizontally between plates 18 and 19 for support purposes, and includes suitable opening means 22 forming a gas discharge means for the plenum. Plates 18 and 19 extend inwardly from brace 21 toward the head of assembly 12. The inner end portion of upstream plate 18 merges into a U-shaped member which includes an upstream gradually curved portion 23 which in turn merges into a horizontal flat pressure plate 24 adapted to be disposed in general parallelism with the travelling web 2. Pressure plate 24 extends generally toward web slot 6 and merges at its other end portion into a corner 25 having a Coanda surface.

Likewise, the inner end portion of downstream plate 19 merges into a foil plate 26 which inclines inwardly toward and terminates adjacent curved corner 25 to form a restrictive gas discharge slot-like primary nozzle 27. The construction is such that nozzle 27 has a Coanda effect whereby air continuously flowing therethrough tends to follow around curved corner 25 and be directed upstream through the gas flow zone 28 between pressure plate 24 and the travelling web 2.

Figure 3:
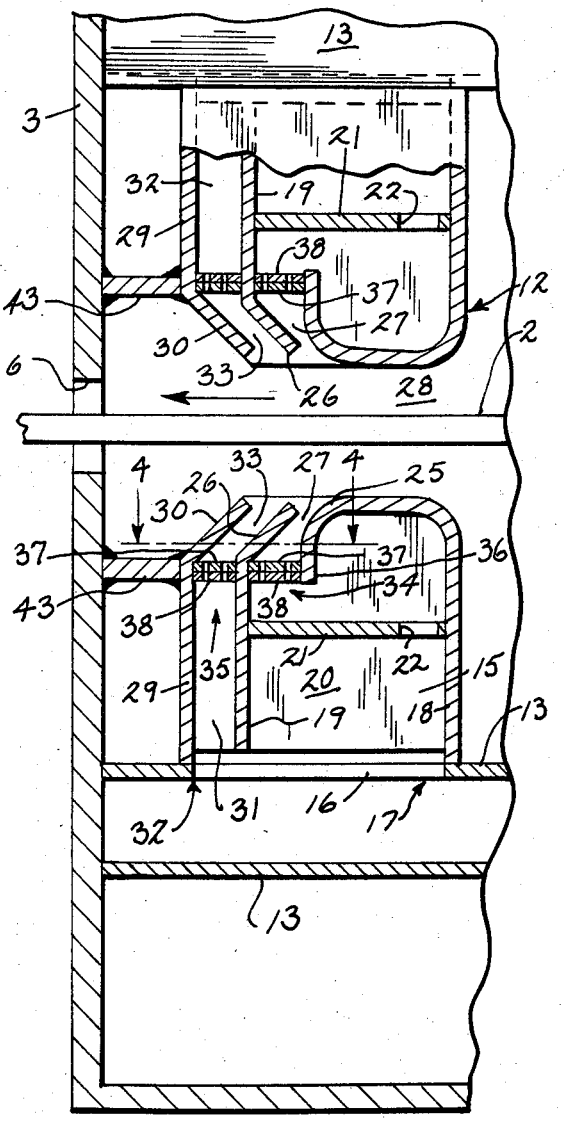
FIG. 3 is an enlarged sectional view of the left end portion of the dryer of FIG. 1, and more fully illustrating the nozzle assembly construction and one relative placement of a nozzle pair.

The construction so far described is generally conventional. The improved aspect of nozzle assembly 12 will now be set forth. As best shown in FIG. 3, and in the present embodiment, a supplemental nozzle means, not of the coanda type, is disposed between nozzle 27 and the housing wall containing web discharge slot 6. For this purpose, a further side plate 29 is mounted laterally along one edge portion to base plate 16 and is mounted at its ends to end closure plates 20 to form the elongated downstream nozzle assembly closure wall. Side plate 29 is spaced downstream from plate 19 on the side remote from plate 18, and in this embodiment is generally parallel to plate 19. The inner end portion of plate 29 merges into a plate 30 which is inclined toward curve 25 of Coanda nozzle 27, and is shown in this embodiment as being generally parallel to foil plate 26.

Plates 19 and 29 form a narrow passage 31 therebetween which communicates with plenum 13, as at 32, and which forms a restrictive gas discharge slot-like supplemental nozzle 33 which discharges a jet of gas generally parallel to the Coanda nozzle jet.

Supplemental nozzle 33, which shares the same air source with nozzle 27 through manifold pipe 13, creates a source of low velocity air which serves as a replacement for room air infiltrating through the web slots and satisfies the Coanda jet's need to induce air from its surroundings. Any tendency of room air to infiltrate through slot 6 between web 2 and the respective nozzle 27 is essentially defeated. Optimum results have been found to occur when the gas discharge velocities through nozzles 27 and 33 are suitably relatively adjusted. For a Coanda nozzle orifice size of 0.080" and a pressure plate-to-web distance of 0.1875" and a nozzle width of a 2½"–4", which is typical, and with an essentially neutral chamber pressure (± about 0.2" water column), the ratio of discharge velocities between nozzles 27 and 33 should preferably be about 12 to 1, and the ratio of discharge volumes should preferably be about 1.7 to 1 respectively.

For the purpose of adjusting the relative velocities, adjustment means for each air flow path are provided. In the embodiment shown in FIGS. 3 and 4, an adjustable air damper valve 34 is disposed in the air flow path for Coanda nozzle 27, while a similar adjustable air damper valve 35 is disposed in the air flow path for supplemental nozzle 33. Valve 34 is disposed between terminus protion 36 of the aforesaid U-shaped portion, adjacent curved corner 25; while valve 35 is disposed between plates 19 and 29. Each valve 34, 35 comprises a pair of elongated mating plates 37, 38, each of which have respective openings 39, 40 therein. An end of one of the plates, such as plate 39, is provided with means for slidingly adjusting it relative to the other plate 40. Such means may comprise any suitable well-known device, such as a manually graspable nut 41 threaded onto a shaft 42 fixed to a wall of housing 3. The adjustment is easily made for either valve between a "wide open" mode wherein openings 39 and 40 are in complete registry, to a "closed" mode wherein the openings are fully out of registry.

The resultant construction provides an air replacement system wherein room air which flows through web slot 6 formed in the housing wall will not be drawn past nozzle 12 and cannot flow further along the web.

In a broad sense, housing wall 3 defines a boundary between two adjacent zones having different ambient air. In the disclosed embodiment, one zone contains external room air and the other zone contains dryer air. The nozzle assemblies of the invention could be employed in a situation wherein the adjacent zones are both disposed within the dryer housing itself, such as a solvent recovery zone and a curing zone or possibly a high and a low temperature zone.

In both instances, the nozzle assembly of the invention may be positioned on either side of the boundary and closely adjacent thereto, and functions to substantially keep separate the air in the adjacent zone. This is accomplished by taking advantage of a Coanda jet's need to pull air in from its surroundings and propel it along with the body of the Coanda jet. In the zone where the aforesaid boundary comprises a housing wall 3, the nozzle assembly of the invention provides the needed air from its source and in place of the air in the zone on the other boundary side. If the boundary is between zones within the housing and is not a separate physical structure but is an arbitrary separation of air having different characteristics, the nozzle assembly provides the needed air to the Coanda jet in place of air from the other side of the boundary.

In some instances, a small amount of room air may nevertheless tend to flow through slot 6 and laterally along the outer face of said plate 29. This could cause a "short circuiting" between the room air and dryer air adjacent slot 6, causing transient air currents inside chamber 4 and web or air flow instability. Means are provided to eliminate this problem, and in the present ebodiment comprises an elongated horizontal seal plate 43 which is coextensive with nozzle assembly 12 and which is secured between housing wall 3 and side plate 29 of supplemental nozzle 33, as by welding or any other suitable mounting means. See FIG. 3. Seal plate 43 is disposed as closely as possible adjacent slot 6 and the discharge of nozzles 33 and 27 and is spaced the shortest distance possible from web 2; that is, at the head end of nozzle assembly 12, adjacent the merging of plates 29 and 30. Thus, any minor amount of air which may infiltrate through slot 6 will be at least partially blocked by seal plate 43.

FIG. 3 illustrates the downstream dryer construction wherein a pair of nozzle assemblies 12 are arranged with web 2 therebetween, with the nozzle discharge jets facing the web. Infiltration of room air through web discharge slot 6 is thus substantially reduced on both sides of the web. The upstream nozzle assemblies 11 shown in FIG. 1 are substantially identical in construction and mounting, execept that they are essentially mirror images of assemblies 12 with their nozzle discharges facing in the opposite direction. Assemblies 11 perform the same function as assemblies 12 and substantially reduce infiltration of room air through web entrance slot 5.

Figure 2:
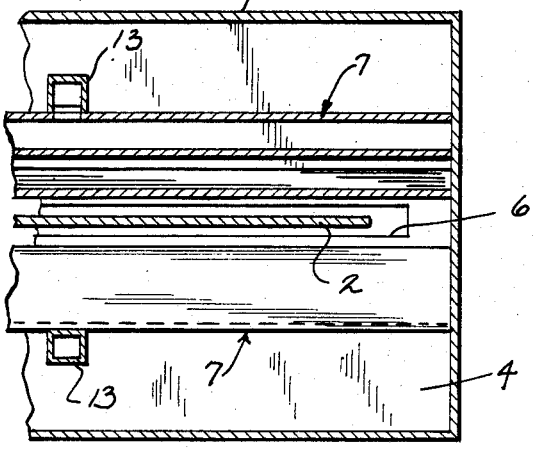
FIG. 2 is a transverse section taken on line 2—2 of FIG. 1.
Figure 5:
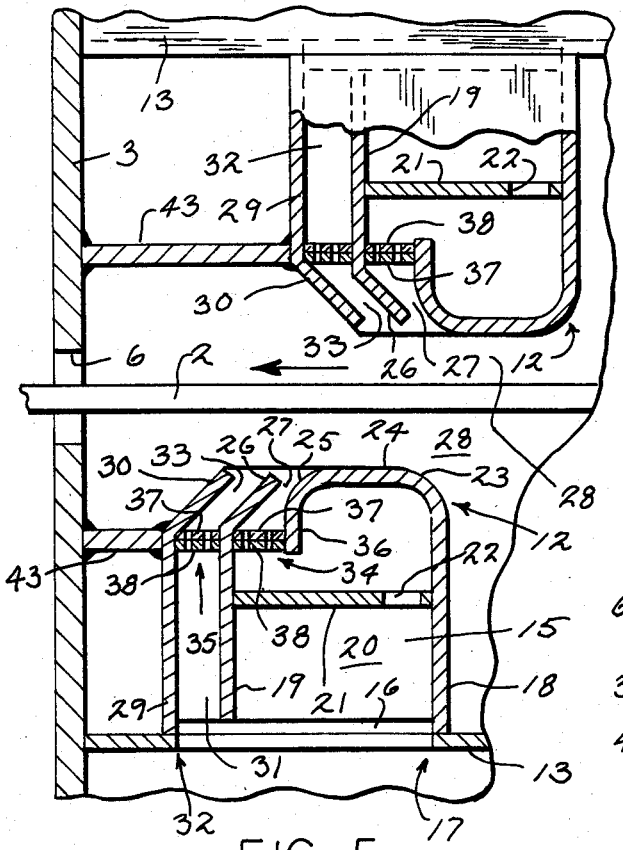
FIG. 5 is a view similar to FIG. 3, reduced in size, and showing a second relative placement of a nozzle pair.
Figure 6:
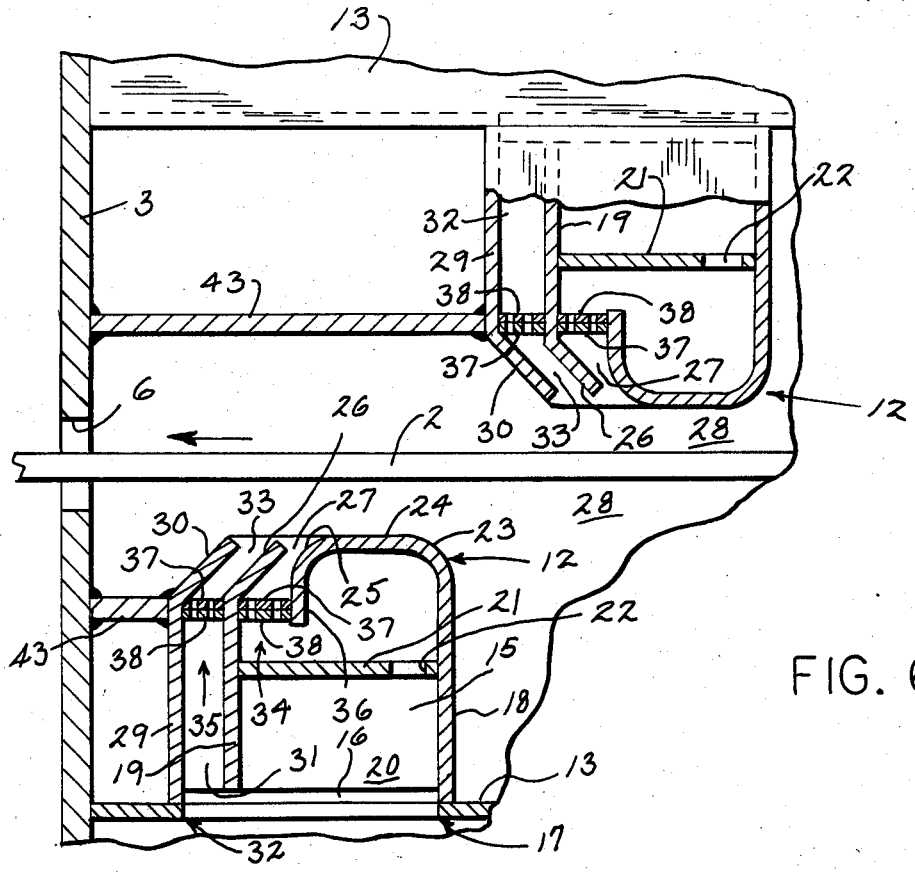
FIG. 6 is a further view showing yet another relative placement of a nozzle pair.

In the embodiment of FIGS. 1 and 2, each pair of nozzle assemblies 11, 12 are shown as disposed in directly opposing relationship across web 2 with each nozzle 27, 33 being disposed in a plane transverse to the web. In some instances, it may be desirable to offset each pair of nozzle assemblies longitudinally of web 2. In the embodiment of FIG. 5, downstream assemblies 12 are staggered so that upper assembly 12 is offset upstream from lower assembly 12, but the assemblies are still in partial overlapping relationship across the web. In the embodiment of FIG. 6, downstream assemblies 12 are offset to the point that they do not overlap across web 2, but instead individually face empty spaces across the web.

In the embodiments of FIGS. 5 and 6, the offset assemblies are also sealed to the closest adjacent housing wall 3 by a seal plate 43. Furthermore, nozzle assemblies 11 may also be offset in a similar manner as assemblies 12 if desired.

The above-described construction, while substantially reducing the undesirable infiltration of room air into dryer chamber 4, does not eliminate infiltration 100%. If web 2 is narrower than the length of nozzle assemblies 11 and 12, there would be poor uniformity of air flow along the width of the web slots. Furthermore, any cool air which does penetrate the slots and somehow contacts the warmer surfaces of seal plates 43 or the nozzle assemblies may cause undesirable condensation on these surfaces, which may drip onto web 2. Therefore, means are provided to solve these problems.

Figure 7:
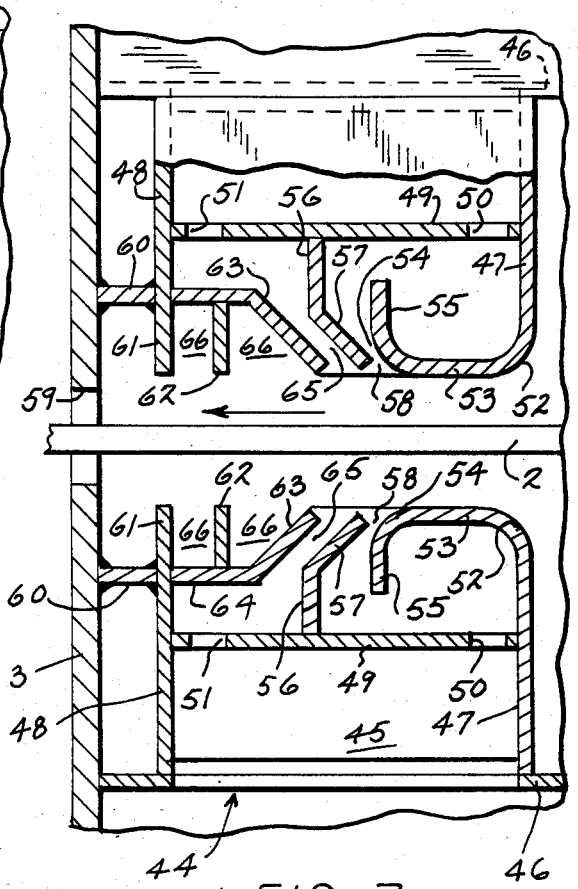
FIG. 7 is a schematic showing of a nozzle assembly modification incorporating a labyrinth.

For this purpose, and referring to FIG. 7, nozzle assemblies 11 and 12 may be modified or possibly replaced by a nozzle assembly 44 which includes an elongated plenum chamber 45 formed by a base plate 46 which has openings (not shown) which communicate with manifold pipe 13, similar to base plate 16. Assembly 44 also includes spaced vertical side plates 47 and 48 which are coextensive with base plate 46, and the usual end closure plates (not shown). A brace 49 extends horizontally between side plates 47 and 48, is secured to the assembly end plates, and is provided with openings 50 and 51 along its side edges adjacent plates 47 and 48 respectively, forming a gas discharge means for the plenum. Side plates 47 and 48 extend inwardly from brace 49 toward the head end of assembly 44. The inner or head end portion of side plate 47 merges into a U-shaped member at a gradually curved portion 52 which in turn merges into a horizontal flat pressure plate 53 parallel to web 2. Pressure plate 53 merges at its other end portion into a curved corner 54 forming a reverse bent portion 55 which is spaced from plate 48. An upstanding plate 56 extends from brace 49 toward the nozzle head end, and has a foil plate 57 on its outer end which inclines toward corner 54 to form an air discharge nozzle 58 of the Coanda type.

Side plate 48 terminates a short distance from web 2 and is disposed relatively close to one of the web-receiving slots 59 in the wall of housing 3. A seal plate 60 is also disposed between wall 3 and plate 48. For purposes of solving the aforementioned web width and/or condensation problems, an expansion chamber means extends inwardly into assembly 44 from the terminus end portion of plate 48. As shown, the expansion chamber means comprises a labyrinth of transversely spaced baffles 61, 62, 63 coextensive with assembly 44, with the baffles extending toward web 2 and joined by a horizontal floor plate 64. Outer baffle 61 is formed by the inner end portion of plate 48, while innermost baffle 63 is inclined and spaced slightly from and generally parallel to Coanda foil plate 57 to form therewith a secondary nozzle 65 similar to nozzle 33. Flow control means, not shown, similar to valves 34 and 35 are preferably mounted in the two air flow passages leading to the nozzle discharges. Baffle 62 is shown as being disposed between baffles 61 and 63. The baffles form a pair of side-by-side expansion chambers 66. More such chambers could be provided without departing from the spirit of the invention.

Any room air that infiltrates through slot 59 will encounter and enter expansion chambers 66, which will distribute any non-uniform induced air flows laterally along the length of the nozzle so that any small amount of air pulled from the room is pulled in uniformly and will not adversely affect a web which is narrower than the nozzle, due to turbulence or otherwise.

The construction is such that floor plate 64 for expansion chambers 66 is disposed in opposed spaced relationship with opening 51, through which the warmed manifold air passes. The result is that this warmed air impinges on plate 64 and tends to warm the cooler infiltrated room air disposed in chambers 66. By reducing the temperature differential between the room air and internal dryer air through the use of what is effectively a heat exchanger, the aforementioned condensation problems are reduced.

The various aspects of the invention provide a unique improvement over previously known nozzle-type web dryers. Not only is the overall air infiltration into a dryer zone substantially reduced, but any small infiltration that may still occur is promptly dealt with in an effective and efficient manner.

Various modes of carrying out the invention are contemplated as being within the scope of the following claims particularly pointing out and distinctly claiming the subject matter which is regarded as the invention.

I claim:

1. For use in a web dryer (1) for drying a moving flexible web (2) of material and wherein the dryer forms at least two adjacent zones, each having different ambient air therein, air infiltration control means for controlling air tending to ifiltrate from one zone to another through the boundary therebetween, said control means comprising, in combination:

(a) a nozzle assembly (11, 12, 44) adapted to be disposed adjacent a said zone boundary and adapted to be connected to air source means, said nozzle assembly having a head end disposed to face a moving web, (b) said assembly including a Coanda nozzle (27, 58) for discharging air from said air source means and through said head end of said assembly and hence in a given direction between the said web and said head end of said assembly and away from said zone boundary, (c) and a secondary nozzle (33, 65) disposed closely adjacent said Coanda nozzle and adapted to be disposed between said Coanda nozzle and said zone boundary, and with said secondary nozzle forming means for discharging air from said air source means so that the discharged air flows only in said given direction and toward said Coanda nozzle, (d) said secondary nozzle (33, 65) further comprising means for supplying induction air to the vicinity of said Coanda nozzle (27, 58).

2. The control means of claim 1 wherein said nozzle assembly (11, 12) comprises:

(a) a base plate (16), (b) a first plate (18) connected to and extending laterally from said base plate, said first plate merging into a generally U-shaped member forming a pressure plate (24) and a curved Coanda surface (25), (c) a second plate (19) connected to and extending laterally from said base plate, said second plate being spaced from said first plate (18) to form a plenum chamber (15), and having a foil plate (26) thereon for cooperating with said Coanda surface (25) to form said Coanda nozzle (27), (d) and a third plate (29) connected to and extending laterally from said base plate, said third plate being spaced from said second plate (19) on the side of the latter remote from said first plate (18), and cooperating with said second plate to form said secondary nozzle (33).

3. For use in a web dryer (1) for drying a moving flexible web (2) of material and wherein an internal dryer chamber (4) formed by a housing wall (3) is supplied with drying air and the web moves through the chamber between narrow entrance and discharge slots (5, 6, 59) disposed in the dryer housing wall (3), air infiltration control means for controlling air tending to infiltrate through the slots from externally of the dryer into the dryer chamber, said control means comprising, in combination:

(a) a nozzle assembly (11, 12, 44) adapted to be disposed adjacent a said slot within a said dryer and adapted to be connected to air source means, said nozzzle assembly having a head end positioned to face a moving web, (b) said assembly including a Coanda nozzle (27, 58) for discharging air from said air source means and through said head end of said assembly and hence in a given direction between the said web and said head end of said assembly and away from said housing wall, (c) and a secondary nozzle (33, 65) disposed closely adjacent said Coanda nozzle and adapted to be disposed between said Coanda nozzle and said housing wall adjacent a said slot, and with said secondary nozzle forming means for discharging air from said air source means so that the discharged air flows only in said given direction and toward said Coanda nozzle, (d) said secondary nozzle (33, 65) further comprising means for supplying induction air to the vicinity of said Coanda nozzle (27, 58).

4. The control means of claim 3 in which said secondary nozzle (33, 65) forms part of said nozzle assembly (11, 12, 44).

5. The control means of claim 4 wherein said nozzle assembly (11, 12) comprises:

(a) a base plate (16), (b) a first plate (18) connected to and extending laterally from said base plate, said first plate merging into a generally U-shaped member forming a pressure plate (24) and a curved Coanda surface (25), (c) a second plate (19) connected to and extending laterally from said base plate, said second plate being spaced from said first plate (18) to form a plenum chamber (15), and having a foil plate (26) thereon for cooperating with said Coanda surface (25) to form said Coanda nozzle (27), (d) and a third plate (29) connected to and extending laterally from said base plate, said third plate being spaced from said second plate (19) on the side of the latter remote from said first plate (18), and cooperating with said second plate to form said secondary nozzle (33).

6. The control means of claim 4 which includes seal means (43, 60) disposed adjacent said head end of said nozzle assembly (11, 12, 44) and adapted to extend into engagement with said housing wall (3) adjacent a said slot (5, 6, 59) to reduce transient air currents within the dryer chamber (4).

7. The control means of claim 3, 4, 5 or 6:

(a) in which said Coanda nozzle (27, 58) and said secondary nozzle (33, 65) are adapted to be connected to said air source means through separate air flow paths, (b) and adjustable damper means (34, 35) disposed in each of said air flow paths for balancing the air flow discharging from said Coanda and supplemental nozzles.

8. The control means of claim 3, 4, 5 or 6 which includes:

(a) expansion chamber means (61–64, 66) adapted to be disposed on the side of said supplemental nozzle (65) remote from said Coanda nozzle (58) to laterally distribute any external air which may have infiltrated through a said slot (59), (b) said expansion chamber means having a wall member (63) forming part of said secondary nozzle (65).

9. The control means of claim 3, 4, 5 or 6 which includes: expansion chamber means (61–64, 66) disposed on the side of said supplemental nozzle (65) remote from said Coanda nozzle (58) to laterally distribute any external air which may have ifiltrated through a said slot (59).

10. The control means of claim 9 in which said expansion chamber means (61–64, 66) forms part of said nozzle assembly (44).

11. The control means of claim 10 in which said expansion chamber means (61–64, 66) forms a heat exchanger between infiltrating air and internal dryer air.

12. The control means of claim 11:

(a) in which said Coanda nozzle (27, 58) and said secondary nozzle (33, 65) are adapted to be connected to said air source means through separate air flow paths, (b) and adjustable damper means (34, 35) disposed in each of said air flow paths for balancing the air flow discharging from said Coanda and supplemental nozzles.

13. In a web dryer (1) for drying a moving flexible web (2) of material, the combination comprising:

(a) a walled housing (3) forming a drying chamber (4) and with said housing having narrow entrance and discharge slots (5, 6, 59) through which the web moves, (b) a nozzle assembly (11, 12, 44) disposed adjacent a said slot within said housing and connected to air source means, said nozzle assembly having a head end positioned to face a moving web, (c) said assembly including a Coanda nozzle (27, 58) for discharging dryer air from said air source means and through said head end of said assembly and hence in a given direction between the said web and said head end of said assembly and away from the housing wall, (d) and a secondary nozzle (33, 65) disposed closely adjacent said Coanda nozzle and disposed between said Coanda nozzle and said housing wall adjacent a said slot, and with said secondary nozzle forming means for discharging dryer air from said air source means so that the discharged air flows only in said given direction and toward said Coanda nozzle, (e) said secondary nozzle (33, 65) further comprising means for supplying induction air to the vicinity of said Coanda nozzle (27, 58).

14. The control means of claim 13 in which said secondary nozzle (33, 65) forms part of said nozzle assembly (11, 12, 44).

15. The control means of claim 14 wherein said nozzle assembly (11, 12) comprises:

(a) a base plate (16), (b) a first plate (18) connected to and extending laterally from said base plate, said first plate merging into a generally U-shaped member forming a pressure plate (24) and a curved Coanda surface (25), (c) a second plate (19) connected to and extending laterally from said base plate, said second plate being spaced from said first plate (18) to form a plenum chamber (15), and having a foil plate (26) thereon for cooperating with said Coanda surface (25) to form said Coanda nozzle (27), (d) and a third plate (29) connected to and extending laterally from said base plate, said third plate being spaced from said second plate (19) on the side of the latter remote from said first plate (18), and cooperating with said second plate to form said secondary nozzle (33).

16. The control means of claim 14 which includes seal means (43, 60) disposed adjacent said head end of said nozzle assembly (11, 12, 44) and extending into engagement with said housing wall (3) adjacent a said slot (5, 6, 59) to reduce transient air currents within the dryer chamber (4).

17. The control means of claim 14:

(a) in which said Coanda nozzle (27, 58) and said secondary nozzle (33, 65) are connected to said air source means through separate air flow paths, (b) and adjustable damper means (34, 35) disposed in each of said air flow paths for balancing the air flow discharging from said Coanda and supplemental nozzles.

18. The control means of claim 14 which includes:

(a) expansion chamber means (61–64, 66) adapted to be disposed on the side of said supplemental nozzle (65) remote from said Coanda nozzle (58) to laterally distribute any external air which may have infiltrated through a said slot (59), (b) said expansion chamber means having a wall member (63) forming part of said secondary nozzle (65).

19. The control means of claim 14 which includes: expansion chamber means (61–64, 66) disposed on the side of said supplemental nozzle (65) remote from said Coanda nozzle (58) to laterally distribute any external air which may have infiltrated through a said slot (59).

20. The control means of claim 19 in which said expansion chamber means (61–64, 66) forms a heat exchanger between infiltrating air and internal dryer air.

21. The web dryer of claim 13:

(a) which includes a pair of nozzle assemblies (11 or 12) disposed with said web (2) therebetween, (b) said pair of assemblies being disposed in directly opposing relationship across said web (FIGS. 1 and 2).

22. The web dryer of claim 13:

(a) which includes a pair of nozzle assemblies (11 or 12) disposed with said web (2) therebetween, (b) one of said assemblies of said pair being offset from the other assembly of said pair in a direction longitudinally of said web (FIGS. 5 and 6).

* * * * *

UNITED STATES PATENT AND TRADEMARK OFFICE

CERTIFICATE OF CORRECTION

PATENT NO. : 4,606,137

DATED : August 19, 1986

INVENTOR(S) : RODGER E. WHIPPLE

It is certified that error appears in the above-identified patent and that said Letters Patent is hereby corrected as shown below:

In Column 1, line 62, after "chamber" delete "of" and insert --or--

Figure 4:
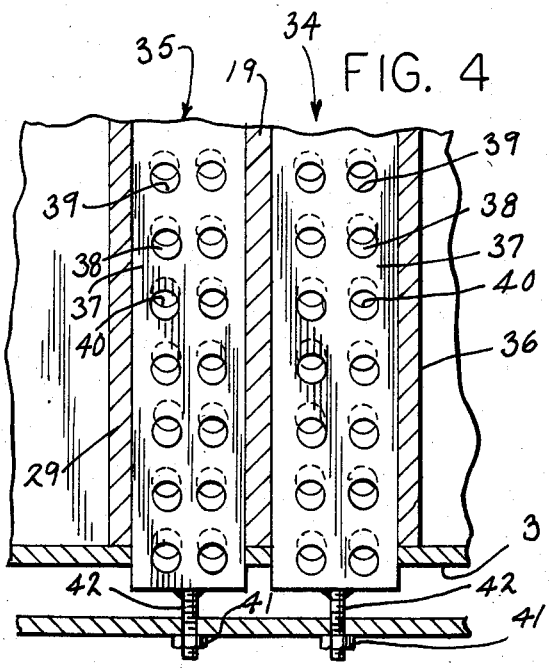
FIG. 4 is a horizontal section taken on line 4—4 of FIG. 4 and showing the air flow control means.

In Column 2, line 63, delete "FIG. 4" before "and" and insert --FIG. 3 --

In Column 3, line 20, delete "sies" and insert --side--

In Column 3, line 60, after "head" insert --end--

In Column 5, line 34, before "plate 29" delete "said" and insert --side--

In Column 5, line 39, delete "ebodiment" and insert --embodiment--

In Column 5, line 58, delete "execept" and insert --except--

In Claim 1, column 7, line 38, delete "ifiltrate" and insert --infiltrate--

In Claim 3, column 8, line 26, delete "nozzzle" and insert --nozzle--

In Claim 9, column 9, line 28, delete "ifiltrated" and insert --infiltrated--

Signed and Sealed this

Eleventh Day of November, 1986

*Attest:*

DONALD J. QUIGG

*Attesting Officer* *Commissioner of Patents and Trademarks*